US008169328B2

(12) United States Patent
Duvall et al.

(10) Patent No.: US 8,169,328 B2
(45) Date of Patent: May 1, 2012

(54) PROXIMITY MONITORING AND LOCATING SYSTEM

(75) Inventors: William R. Duvall, Sudbury, MA (US); Joseph T. Lipowski, Norwell, MA (US); James Justice, Medfield, MA (US); Vincentzio I. Roman, Framingham, MA (US)

(73) Assignee: LoJack Operating Company, LP, Canton, MA (US)

( * ) Notice: Subject to any disclaimer, the term of this patent is extended or adjusted under 35 U.S.C. 154(b) by 451 days.

(21) Appl. No.: 12/455,927

(22) Filed: Jun. 9, 2009

(65) Prior Publication Data

US 2010/0309002 A1 Dec. 9, 2010

(51) Int. Cl.
*G08B 23/00* (2006.01)

(52) U.S. Cl. ..... 340/573.4; 340/539.13; 340/539.21; 340/539.23; 340/686.6; 340/825.49

(58) Field of Classification Search ..... 340/539.13, 340/539.15, 539.21, 539.23, 825.36, 825.49, 340/573.1, 573.4, 686.6, 825.69, 825.72
See application file for complete search history.

(56) References Cited

U.S. PATENT DOCUMENTS

| | | | | |
|---|---|---|---|---|
| 4,177,466 | A | 12/1979 | Reagan | |
| 4,818,998 | A | 4/1989 | Apsell et al. | |
| 4,873,527 | A | 10/1989 | Tan | |
| 5,170,426 | A | 12/1992 | D'Alessio et al. | |
| 5,504,474 | A | 4/1996 | Libman et al. | |
| 5,731,757 | A | 3/1998 | Layson, Jr. | |
| 5,831,535 | A | 11/1998 | Reisman et al. | |
| 5,870,029 | A | 2/1999 | Otto et al. | |
| 5,917,423 | A | 6/1999 | Duvall | |
| 5,936,529 | A | 8/1999 | Reisman et al. | |
| 5,959,533 | A | 9/1999 | Layson, Jr. et al. | |
| 5,982,281 | A | 11/1999 | Layson, Jr. | |
| 6,014,080 | A | 1/2000 | Layson, Jr. | |
| 6,100,806 | A | 8/2000 | Gaukel | |
| 6,229,988 | B1 | 5/2001 | Stapefeld et al. | |
| 6,392,547 | B1 * | 5/2002 | Stewart et al. | 340/573.1 |
| 6,462,664 | B1 | 10/2002 | Cuijpers et al. | |
| 6,522,698 | B1 | 2/2003 | Irving et al. | |
| 6,552,661 | B1 * | 4/2003 | Lastinger et al. | 340/572.1 |
| 6,553,256 | B1 | 4/2003 | Jorgenson et al. | |

(Continued)

OTHER PUBLICATIONS

Sink et al., "Ethnic Differences in the Prevalence and Pattern of Dementia-Related Behaviors", Journal of the American Geriatrics Society, vol. 52, 2004, pp. 1277-1283, Abstract only, 2 pages.

(Continued)

*Primary Examiner* — Hung T. Nguyen
(74) *Attorney, Agent, or Firm* — Iandiorio Teska & Coleman, LLP

(57) ABSTRACT

A combined proximity monitoring and locating system including a wearable unit, a proximity detector, and a control subsystem. The proximity detector includes a receiver for receiving the wearable unit transmitter signal, a processing subsystem configured to signal an alert if the wearable unit transmitter signal strength is below a pre-established minimum, and a tracking subsystem configured to assist in locating the wearable unit based on the signal strength of the wearable unit transmitter signal. A control subsystem is responsive to an indication that the alert has been signaled. The control subsystem includes an RF transmitter configured to transmit a transponder activation signal, and an RF antenna network for relaying the transponder activation signal to a receiver of the portable unit to activate the transponder thereof. A tracking unit includes a receiver configured to receive the transponder signal of the wearable unit to locate the wearable unit.

33 Claims, 5 Drawing Sheets

U.S. PATENT DOCUMENTS

| | | | |
|---|---|---|---|
| 6,665,613 | B2 | 12/2003 | Duvall |
| 6,721,688 | B1 | 4/2004 | Clarke |
| 6,774,799 | B2 | 8/2004 | Defant et al. |
| 6,847,825 | B1 | 1/2005 | Duvall et al. |
| 6,876,858 | B1 | 4/2005 | Duvall et al. |
| 7,049,942 | B2 | 5/2006 | Gallovich |
| 7,091,835 | B2 | 8/2006 | Boulay et al. |
| 7,119,695 | B2 | 10/2006 | Defant et al. |
| 7,205,890 | B2 | 4/2007 | Defant et al. |
| 7,330,122 | B2 | 2/2008 | Derrick et al. |
| D578,918 | S | 10/2008 | Aninye |
| 7,536,169 | B2 | 5/2009 | Duvall |
| 2003/0174059 | A1 | 9/2003 | Reeves |
| 2004/0260463 | A1 | 12/2004 | Hathiram et al. |
| 2005/0285782 | A1 | 12/2005 | Bennett |
| 2006/0007039 | A1 | 1/2006 | Duvall |
| 2006/0294563 | A1 | 12/2006 | Guillorit |
| 2006/0294564 | A1 | 12/2006 | Guillorit |
| 2007/0015518 | A1 | 1/2007 | Winter et al. |
| 2007/0040668 | A1 | 2/2007 | Krishna et al. |
| 2007/0046258 | A1 | 3/2007 | Defant et al. |
| 2007/0066218 | A1 | 3/2007 | Justice et al. |
| 2008/0012760 | A1 | 1/2008 | Derrick et al. |
| 2008/0012761 | A1 | 1/2008 | Derrick et al. |
| 2008/0018458 | A1 | 1/2008 | Derrick et al. |
| 2008/0018459 | A1 | 1/2008 | Derrick et al. |
| 2008/0019082 | A1 | 1/2008 | Krieger et al. |
| 2008/0036667 | A1 | 2/2008 | Fedan |
| 2008/0088437 | A1 | 4/2008 | Aninye et al. |
| 2008/0088438 | A1 | 4/2008 | Aninye et al. |
| 2008/0194925 | A1 | 8/2008 | Alsafadi et al. |
| 2008/0218358 | A1 | 9/2008 | Derrick et al. |
| 2008/0224895 | A1 | 9/2008 | Krishna et al. |

OTHER PUBLICATIONS

U.S. Appl. No. 10/241,259, filed Sep. 10, 2002, Rod S. DeMille.

Remote MDx-Safety and Security through Tracking and Monitoring Solutions, http://www.remotemdx.com/Default.aspx, printed Oct. 24, 2008 (two (2) pages).

Omnilink, http://www.omnilink.com/, printed Oct. 24, 2008 (two (2) pages).

Telehealth Solutions, http://www.medical.philips.com/goto/telemonitoring, printed Oct. 23, 2008 (one (1) page).

Lifeline Sys, http://philips.lifelinesys.com/extended_home_2/?campaign=113&gclid=CPylytWLvpYCFSCysgodNS7, printed Oct. 23, 2008 (one (1) page).

Lifeline Sys, http://philips.lifelinesys.com/extended_how_works2/?campaign=113, printed Oct. 23, 2008 (one (1) page).

Dmatek Markets & Subsidiaries, http://www/dmatek.com/default.asp?PageID=9, printed Feb. 24, 2009 (one (1) page).

Zoombak Personal GPS Locators/Portable GPS Tracker/Vehicle Tracking/Family Car Monitoring, http://www.zoombak.com, printed Oct. 24, 2008 (three (3) pages).

Written Opinion of the International Searching Authority for PCT Application No. PCT/US10/01486 mailed Jul. 23, 2010 (eleven (11) pages).

* cited by examiner

PROXIMITY MONITORING AND LOCATING SYSTEM

FIELD OF THE INVENTION

The subject invention relates to a proximity monitoring and locating system for determining whether a person such as a detainee, a person suffering from Alzheimer's disease, an autistic child, and the like has left a predefined area and, if so, a method of and system for locating the missing person.

BACKGROUND OF THE INVENTION

A typical house arrest or home detention system includes a bracelet worn on a detainee's ankle. A radio transmitter in the bracelet transmits a coded signal received at a base station. Periodically, the detainee is instructed to place the bracelet near the base station unit. If the coded signal is not received, it is evident that the detainee is not at home. See U.S. Pat. No. 5,170,426 incorporated herein by this reference. Other "proximity detection" subsystems exist or have been proposed.

One potential problem with such prior systems is that the actual location of the detainee is not always known if the detainee has left the authorized area. So, those skilled in the art have proposed locater subsystems, such as GPS subsystems, to determine not only whether the detainee has left an authorized area, but also, if so, where the detainee is presently located. See U.S. Pat. No. 6,100,806 incorporated herein by this reference. GPS based subsystems, however, do not work indoors, and can be expensive.

Another use for proximity monitoring and locating systems includes people under the care of a caregiver such as Alzheimer's patients and children with autism. According to one study, about five million American's have Alzheimer's disease and 67% will likely wander during the course of the disease. See Sink, Kobinski, Newcomer & Yacki, "Ethnic Differences in the Prevalence and Pattern of Dementia—Related Behaviors," *The Journal of the American Geriatric Society,* 2004, No. 52: pp. 1277-1283. Other people with disabilities, e.g., children with autism, also periodically wander away from their room, home, and/or caregiver.

Attempting to locate such people can be very difficult and a person can be severely harmed or expire before he or she is located if the locating effort, typically carried out with the help of law enforcement authorities, takes too long or is unsuccessful. Indeed, the period of time between the person leaving the area and detection of that fact is critical to a successful locating effort.

BRIEF SUMMARY OF THE INVENTION

It is therefore an object of the subject invention to provide a new proximity monitoring and locating system for people such as Alzheimer's patients, children with autism, and home detainees.

It is a further object of this invention to provide such a proximity monitoring and locating system which can be used in a wide variety of different applications.

It is a further object of this invention to provide such a proximity monitoring and locating system which can be manufactured inexpensively.

It is a further object of this invention to provide such a proximity monitoring and locating system which includes, as the locating component, several aspects of the applicant's successful and proven LoJack® system.

It is a further object of this invention to provide such a proximity monitoring and locating system which is easy to use.

It is a further object of this invention to provide such a proximity monitoring and locating system which allows a caregiver to attempt locating a missing person before the authorities are informed and become involved.

It is a further object of the subject invention to provide such a proximity monitoring and locating system which determines if a wearable unit is beyond a predetermined area and includes two ways to locate the wearable unit thereby allowing people who require monitoring some level of autonomy.

The subject invention results from the realization that a viable proximity monitoring and locating system, in one embodiment, employs a bracelet transmitter which signals a monitoring unit for proximity detection and initial tracking of the bracelet wherein the bracelet also includes a transponder which can be actuated for tracking purposes if the initial tracking attempt is unsuccessful.

The subject invention features a proximity monitoring and locating system. A wearable unit includes a transmitter configured to send a signal, a receiver, and a transponder outputting a transponder signal when activated. A proximity detector includes a receiver for receiving the wearable unit transmitter signal, a processing subsystem configured to signal an alert if the wearable unit transmitter signal strength is below a pre-established minimum, and a tracking subsystem configured to assist in locating the wearable unit based on the signal strength of the wearable unit transmitter signal. A control subsystem is responsive to an indication that the alert has been signaled, and includes an RF transmitter configured to transmit a transponder activation signal and an RF antenna network for relaying the transponder activation signal to the receiver of the portable unit to activate the transponder thereof. A tracking unit includes a receiver configured to receive the transponder signal of the wearable unit to locate the wearable unit.

In one example, the wearable unit includes a bracelet. Typically, the wearable unit transmitter and the proximity detector receiver operate in an unlicensed frequency such as 902 MHz. The transponder typically emits a signal at 173.075 MHz.

The proximity detector may include a communication link with a control subsystem. In one version, the proximity detector includes a modem and the processing subsystem is configured to notify the control subsystem via the modem when the wearable unit transmitter signal strength is below the pre-established minimum to alert the control subsystem. The communication link may also include an internet connection between the proximity detector and the control subsystem. Another communication link includes a wireless communication link between the proximity detector and the control subsystem.

In one example, the control subsystem includes a database of proximity detectors and wearable units and corresponding message recipients and is configured to send a message to a message recipient when an alert is signaled by a given proximity detector.

Preferably the proximity detector includes a base unit and the tracking subsystem is removable from the base unit in order to assist in an initial locating effort. In alternative versions, the wearable unit further includes a GPS subsystem for tracking the wearable unit, and/or a cell phone modem for tracking the wearable unit and/or for communicating with the wearable unit. It may be useful to include a separate activation unit configured to activate the transponder of the wearable unit.

The subject invention also features a proximity monitoring and locating system comprising a wearable unit including a transmitter configured to send a signal, a receiver, and a transponder outputting a transponder signal when activated. A proximity monitor includes a handheld tracking receiver for receiving the wearable unit transmitter signal, a base unit configured to cradle the handheld tracking receiver, and a processing subsystem configured to monitor the wearable unit transmitter signal strength. The control subsystem includes an RF transmitter configured to transmit a transponder activation signal, and an RF antenna network for relaying the transponder activation signal to the receiver of the portable unit to activate the transponder thereof. A tracking unit includes a receiver configured to receive the transponder signal of the wearable unit to locate the wearable unit. A communication link between the proximity monitor and the control subsystem is for issuing an alert if the signal strength of the wearable unit transmitter is below a pre-established minimum so that the handheld tracking receiver can be used in an attempt to locate the wearable unit before the transponder thereof is activated and the tracking unit is used to locate the wearable unit.

In another aspect, a proximity monitoring and locating system in accordance with the subject invention features a wearable unit including a transmitter configured to send a signal, a receiver, and a transponder outputting a transponder signal when activated. A proximity detection subsystem is configured to determine if the wearable unit is present in a predetermined area. A control subsystem is response to an indication that the proximity detection subsystem had determined that the wearable unit is not within the predefined area. The control subsystem is configured with an RF transmitter configured to transmit a transponder activation signal and an RF antenna network for relaying the transponder activation signal to the receiver of the portable unit to activate the transponder thereof.

A tracking unit with a receiver may be configured to receive the transponder signal of the wearable unit to locate the wearable unit. Preferably, the proximity detection subsystem includes a handheld tracking receiver for receiving the wearable unit transmitter signal, a base unit configured to cradle the handheld tracking receiver, and a processing subsystem configured to monitor the wearable unit transmitter signal strength.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
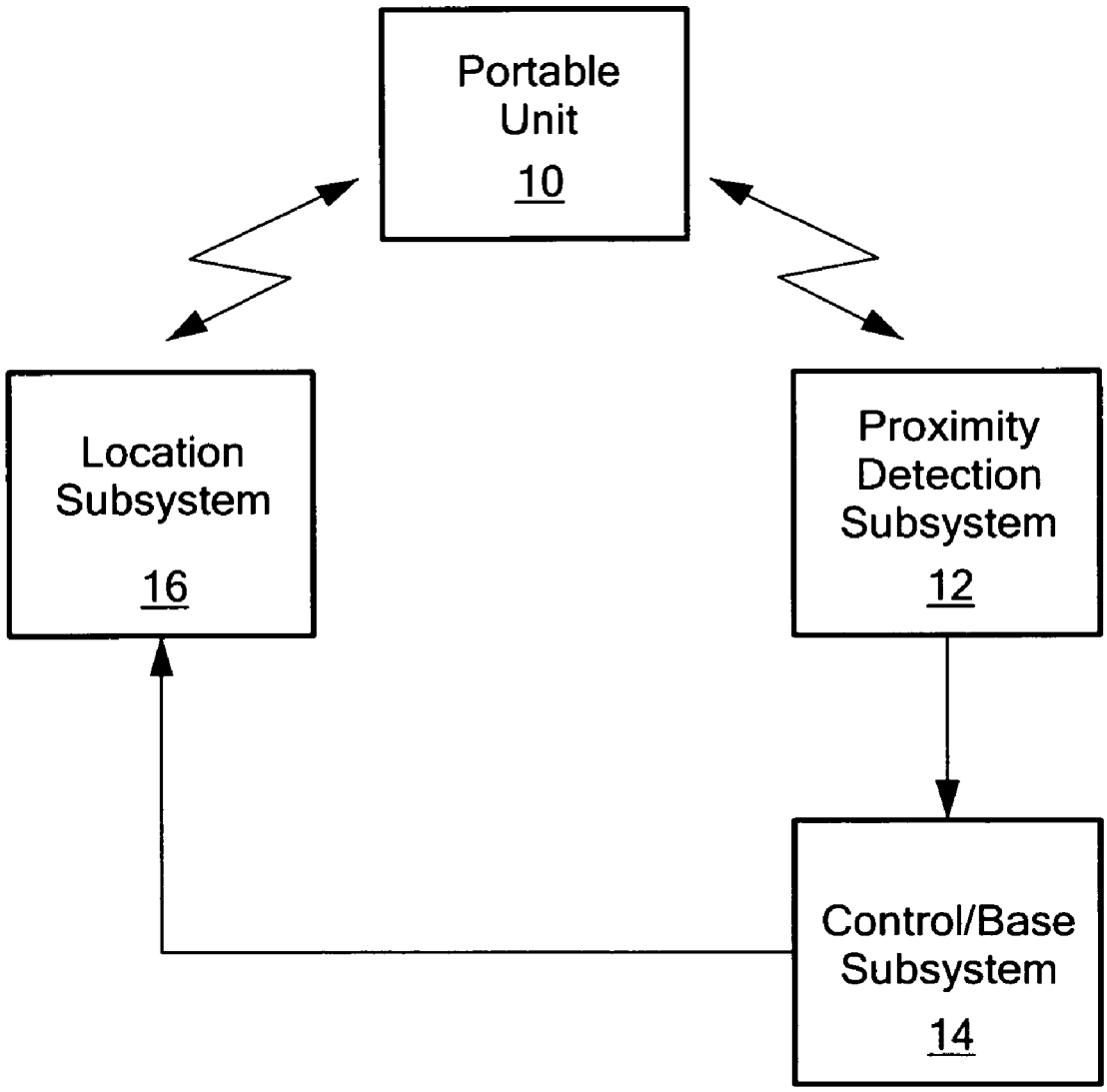
FIG. 1 is a schematic block diagram showing the primary subsystems associated with a typical proximity monitoring and tracking system in accordance with an example of the subject invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

FIG. 1 illustrates several of the primary subsystems associated with an example of the subject invention. Portable unit 10 is monitored by proximity detection subsystem 12 in some fashion. In one example, portable unit 10 is a bracelet worn about the wrist or ankle and includes a transmitter which transmits a signal to proximity detection subsystem 12. If the signal strength of that signal falls below a predetermined minimum, then an alert is issued. Control and Monitoring Center subsystem 14 is notified regarding the alert and locator subsystem 16 is used to locate portable unit 10.

Figure 2:
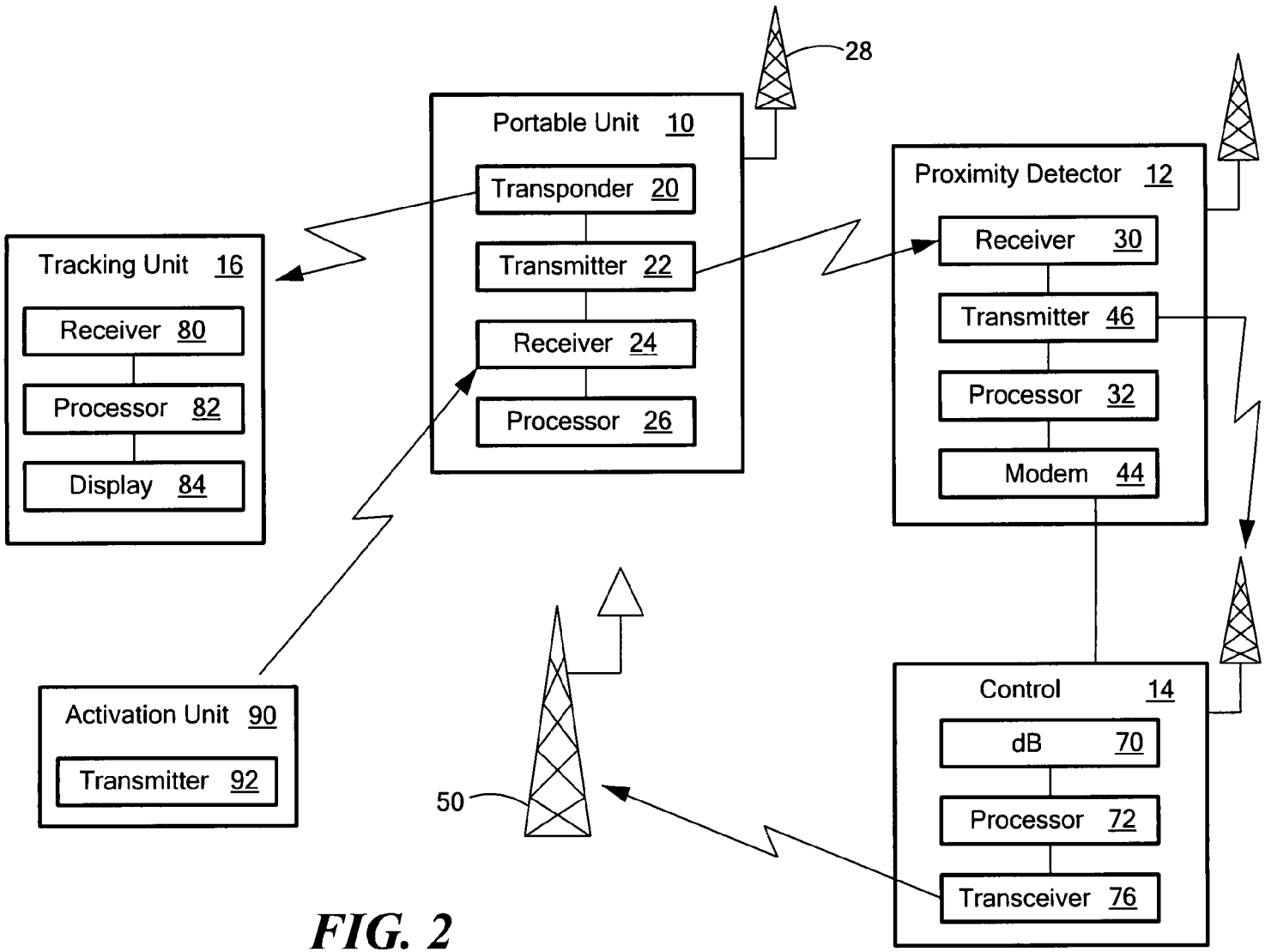
FIG. 2 is a more detailed block diagram showing the primary components associated with a proximity monitoring and tracking subsystem in accordance with an example of the subject invention.
Figure 3:
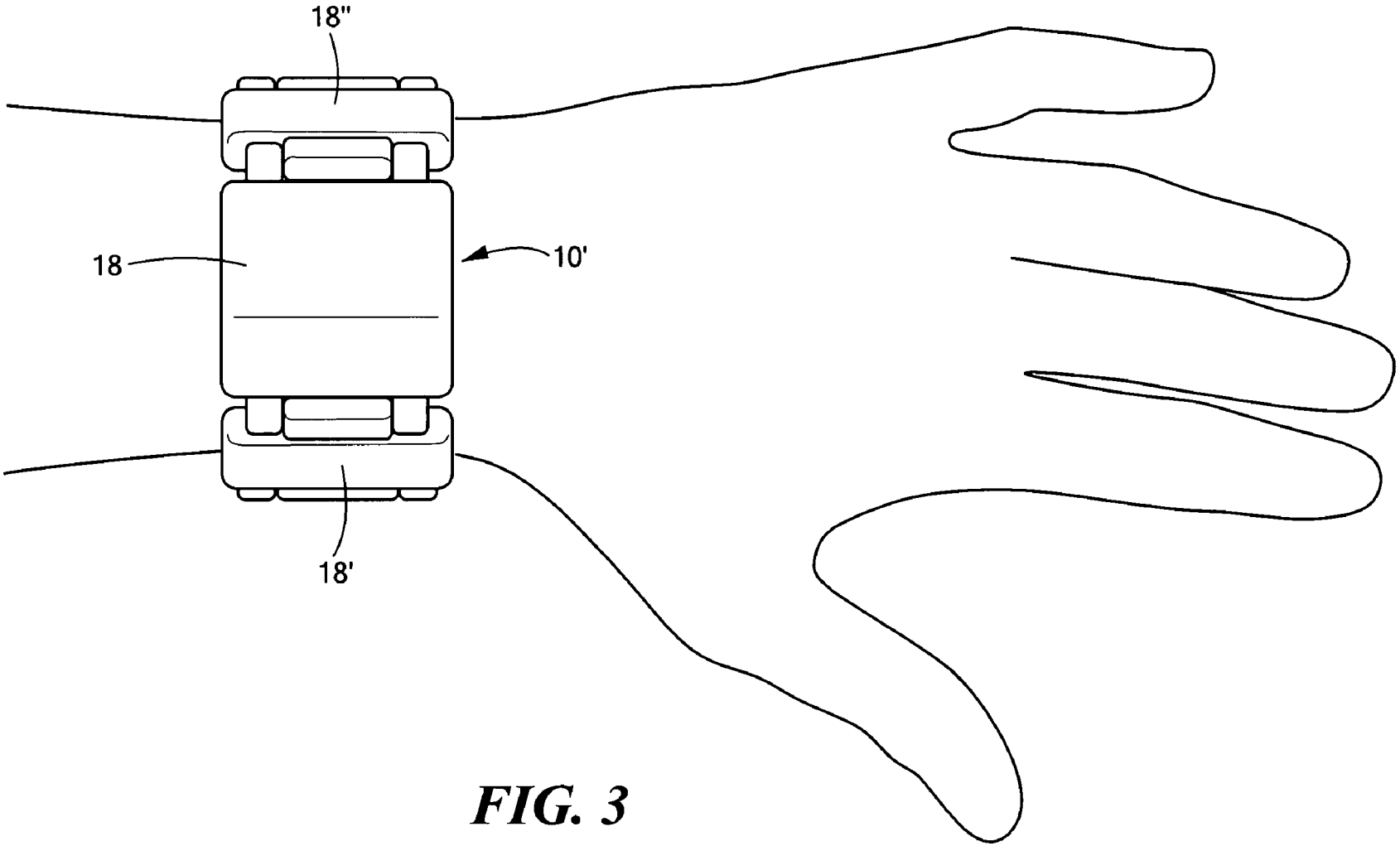
FIG. 3 is a schematic three-dimensional view showing one embodiment of a wearable portable tracking unit in the form of a wrist bracelet.

In one particular embodiment, portable unit 10, FIG. 2 is configured as a wearable unit 10' shown in FIG. 3 with module 18 thereof including a transponder 20, FIG. 2, transmitter 22, receiver 24, processing electronics 26, and antenna 28. Antenna 28 may be configured in accordance with U.S. Pat. No. 4,873,527 incorporated herein by this reference. Transmitter 22, via antenna 28, transmits an RF signal (e.g., at the unlicensed frequency of 902 MHz) to receiver 30 of proximity detector 12.

Processing electronics 32 of detector 12 is responsive to receiver 30 and is configured to provide an alert of some kind if the wearable unit 10 transmitter 22 signal strength is below a pre-established minimum level indicating that wearable unit 10 is beyond an authorized area, has left the room, or a house, the yard, and the like. Typically, each bracelet is coded to a specific proximity detector 12 via some form of an identifier encoded in the signal, transmitted by transmitter 22.

Also, the pre-established minimum signal strength level can be tailored and set vice proximity detector 12 to provide different people with different degrees of freedom. A low level offender, for example, may be authorized to maneuver anywhere in a house or on a residential lot and thus the sensitivity might be set to correspond to a circle with proximity detector 12 at the center and a radius of 300 yards. For an Alzheimer's patient, on the other hand, the radius might be reduced to 25 or even 10 yards.

Control and Monitoring Center system 14 is notified, (via cellular or landline networks, and/or an internet communication channel, or in some other fashion), that an alert has issued. For example, FIG. 2 shows communication link 40 between proximity detector 12 and Control and Monitoring Center system 14. In one example, proximity detector 12 includes modem 44 and processing electronics 32 is programmed to automatically contact, (via cellular telephony, landline telephony, and/or an internet communication channel) control center 14 via modem 44 when the wearable unit transmitter signal strength is below the set pre-established minimum level to alert the control subsystem. Transmitter 46 can also be used to transmit an alert to control center 14 wirelessly (e.g., via RF antenna towers such as tower 50 described further below).

Typically, control center 14 includes database 70 of the identifiers associated with individual portable units and proximity detector serial numbers and corresponding message recipients and includes processing electronics 72 configured to automatically notify a caregiver via a telephone number, a text message, and/or e-mail depending upon the caregiver's preferences. So, proximity detector 12, FIG. 2 may only send a serial number to control center 14 as an indication of an alert situation and database 70 is referenced to determine which caregiver is to be notified and how.

So far, the technology of the subject invention has enabled signaling an alert if portable unit 10 is beyond a predetermined area. Next, a local tracking subsystem is used to locate the individual. For example, receiver 30 of proximity detector 12 can be used to assist in locating wearable unit 10 based on the signal strength of the signal output by transmitter 22 signal of wearable unit 10.

Figure 4:
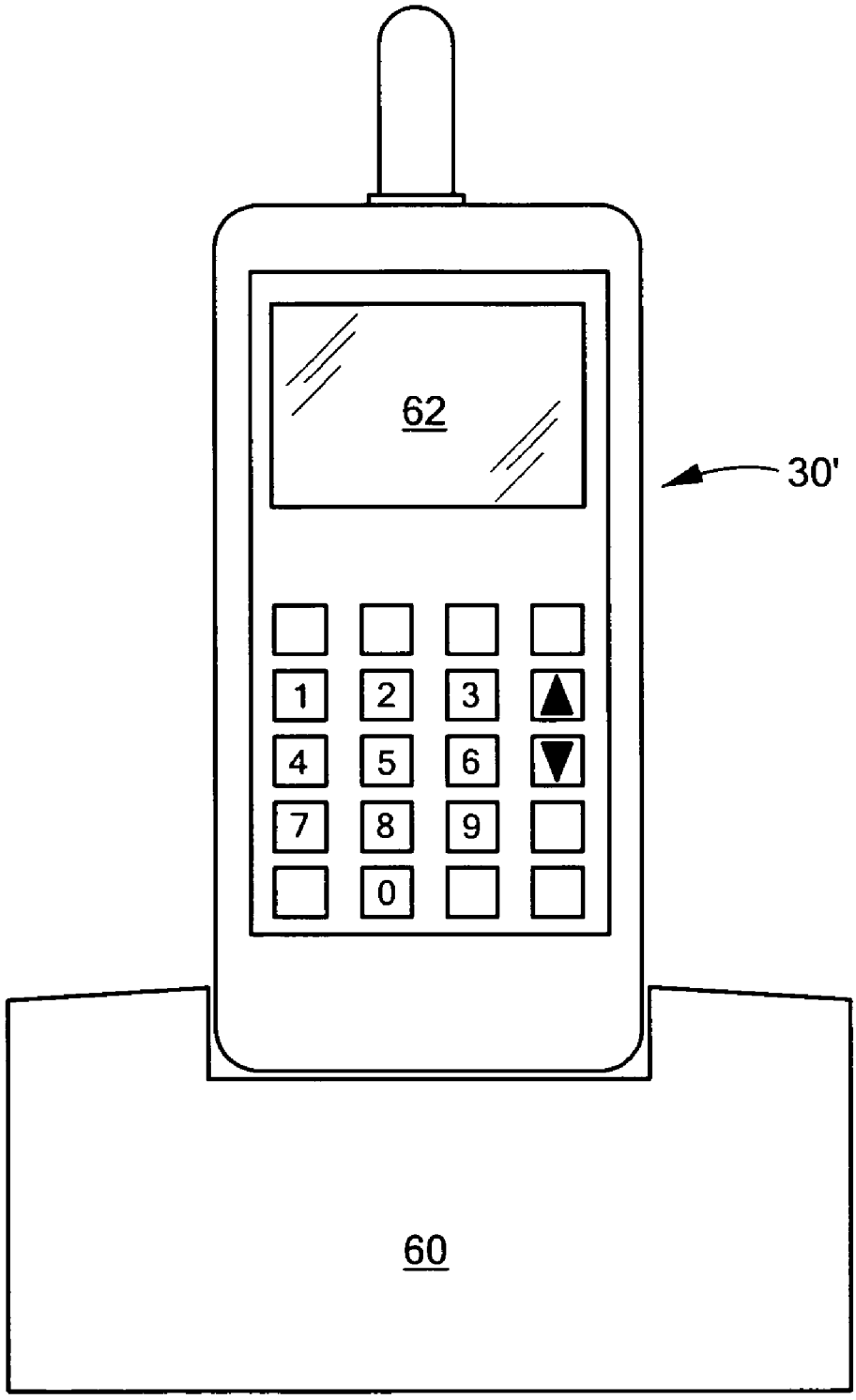
FIG. 4 is a highly schematic three-dimensional view of a proximity detector in accordance with an example of the subject invention.

FIG. 4 shows a handheld tracking receiver 30' which receives the signal emitted by transmitter 22, FIG. 2 of portable bracelet unit 10. Base unit 60, FIG. 4 is configured to cradle hand held receiver 30' and typically includes processing electronics 32, FIG. 2, transmitter 46, modem 44, and the like. A person, e.g., a caregiver alerted by proximity detector 12 itself, and/or control center 14, can use handheld tracking receiver 30', FIG. 4 to begin a search for portable bracelet unit 10, FIG. 2. User interface 62, FIG. 4 provides an indication of the signal strength of transmitter 22 of portable unit 10. The searcher proceeds in the direction that increases signal strength until the missing person is located, or if no signal is received, the searcher can begin walking in circles of increasing diameter until a signal is received.

The result is the unique ability to locate a patient or other person without the need for intervention by the authorities in cases where, for example, the person wearing portable unit 10 has only moved to the garage, basement, or next door neighbor's house, or the like.

If, however, the initial locating effort fails, control center 14, FIG. 2 is so-notified and transmitter (or transceiver) 76 is used to wirelessly activate transponder 20 of portable unit 10 via receiver 24 which receives activation signals relayed by a wireless RF antenna network including towers such as tower 50. See the applicant's U.S. Pat. Nos. 4,177,466; 4,818,998; 5,917,423; 6,229,988; 6,522,698; 6,665,613; 6,876,858; 6,847,825; and 7,091,835 incorporated herein by this reference. See also U.S. patent application Ser. Nos. 10/150,818; 10/241,259; 10/886,870; 11/229,736; 11/207,033; 11/502,191; and 11/716,793 incorporated herein by this reference.

In addition, a caregiver can notify control center 14 in any kind of emergency situation and request the activation of transponder 20 of portable unit 10. Furthermore in areas of the country where a LoJack® network does not provide adequate coverage, remote activation unit 90 can be used to activate transponder 20 via RF transmitter 92. The portable activation unit 90 can be a component of portable unit proximity detector 12, and/or can be added to police vehicles which drive or fly to the last known location of the missing person, or the like.

There are also other ways to activate transponder 20 of portable unit 10. In a more complex design, transponder 20 is automatically activated when the signal strength of transmitter 22, as received by receiver 30 of proximity detector 12, falls below the pre-established minimum. Or, proximity detector 12 may include means for activating transponder 20. In another embodiment, if portable unit 10 includes a cell phone modem, it can be used to activate transponder 20 and also to locate, via cell tower identification and triangulation, for example, the portable unit and/or to communicate with the person wearing the portable unit 10.

Locating the portable unit 10 transponder 20 signal is described in the aforementioned LoJack® patents and, as shown in FIG. 2, tracking unit 16 includes receiver 80, processing electronics 82, and display 84 used by law enforcement personnel to locate portable unit 10 based on the signal emitted by transponder 20. Transponder 20 typically emits a signal at 173.075 MHz when activated.

Usually, the police in a vehicle equipped with tracking unit 16 are told the last known location of proximity detector 12 (e.g., a residential address) and begin their search near that location since tracking unit 16 can receive a transponder signal up to two miles away. In many cases, police and/or Search and Rescue utilize aircraft with tracking unit 16 which extends the tracking range up to twenty miles.

In some embodiments, control center 14 is in communication with the police vehicle equipped with tracking unit 16 to assist in the recovery of a missing person. In other embodiments, bracelet 10', FIG. 3 includes a GPS subsystem for tracking the wearable unit and, as mentioned above, could include a cell phone modem for tracking the wearable unit and/or for communication with the wearable unit. Thus, housing sections 18' and 18" of bracelet 10', FIG. 3 may include a cell phone modem and a GPS unit, respectively. The cell phone unit can be used to activate transponder 20, FIG. 2, to locate portable unit 10 (via cell tower triangulation techniques, for example), or to communicate with the person wearing portable unit 10. The GPS module can also be used to locate portable unit 10 which would further include a transmitter for wirelessly transmitting GPS data to control center 14, proximity detector subsystem 12, and/or tracking unit 16.

Figure 5:
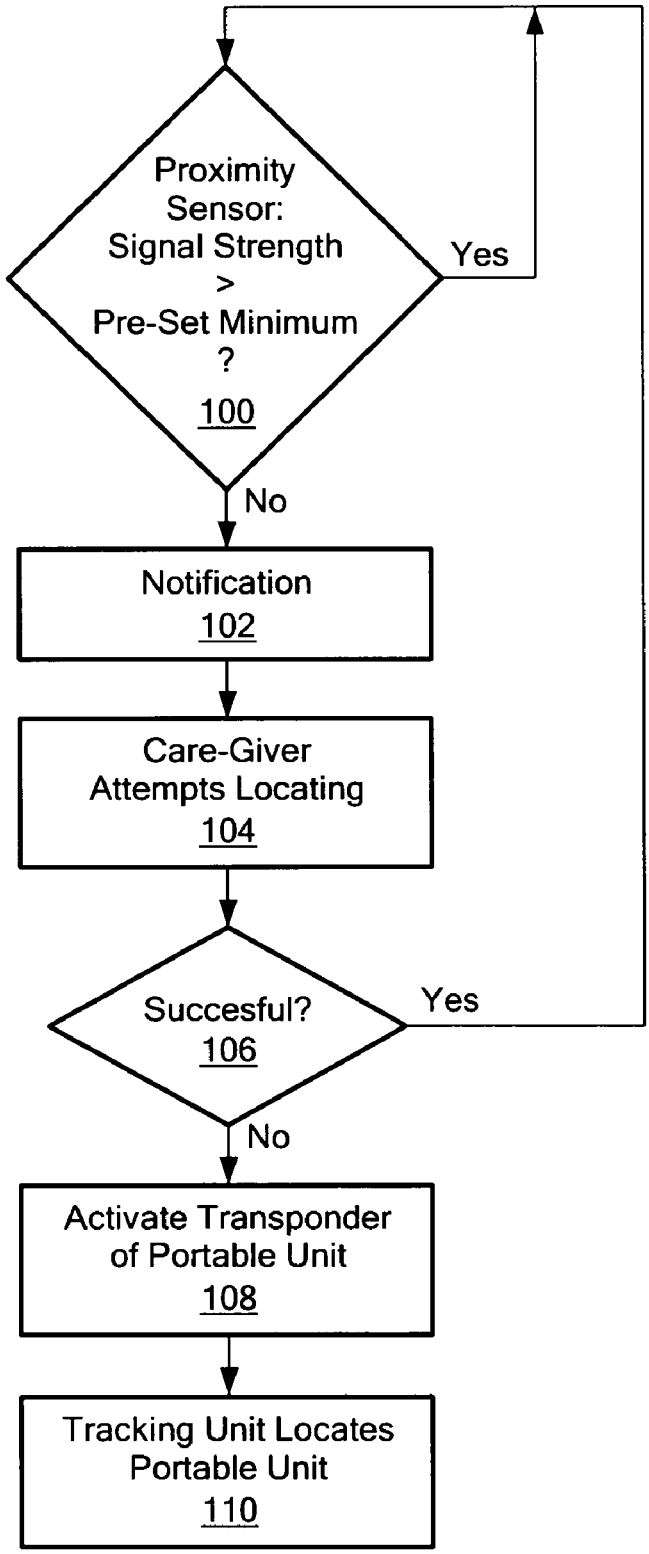
FIG. 5 is a flow chart showing the primary steps associated with operating an embodiment of a proximity monitoring and detection subsystem in accordance with the subject invention.

FIG. 5 describes the typical operation of a system in accordance with the subject invention. In step 100, the portable unit's transmitted signal strength is monitored by proximity detector 12, FIG. 1 to evaluate whether it is greater than a preset minimum. If the signal strength is greater than the preset minimum, no action is taken. When the signal strength of transmitter 22, FIG. 2 is below the preset minimum, a notification, (e.g., an alert) 102, FIG. 5, is provided, typically by proximity detector 12, FIG. 1. The user interface of proximity detector 12 may sound an alarm or provide a visual indication or, as noted above, proximity detector 12, FIG. 2 can be configured to automatically notify control center 14 that the signal strength of the portable unit has fallen below the preset minimum. Thus, the caregiver is notified in one of a number of different ways and the caregiver attempts locating the portable unit, step 104, FIG. 5 as described above using proximity detector 30', FIG. 4, for example.

If this initial locating attempt is successful, step 106, no further action is taken. If this initial attempt is not successful, transponder 20, FIG. 2 of portable unit 10 is activated, step 108, FIG. 5. Again, transponder 20, FIG. 2 may be activated in a number of different ways, but typically the applicant's LoJack® system is employed and an RF signal is relayed via the LoJack® antenna Tower network 50, FIG. 2 to the portable unit to provide a transponder activation signal. Then, tracking unit 16 can be used to locate portable unit 10, step 110, FIG. 5.

The result, in any embodiment, is a novel proximity monitoring and locating system for people such as Alzheimer's patients, children with autism, home detainees, and the like. Preferably, the locating unit includes several aspects of the applicant's successful and proven LoJack® system. The proximity monitoring and locating system is easy to use and allows a caregiver to attempt to locate a missing person before authorities are called or become involved. Uniquely, two ways are provided to locate a missing person: the proximately detector itself can be used to locate the wearable unit and, when activated, the transponder signal emitted by the wearable unit can be used for tracking purposes if the initial tracking attempt is unsuccessful. The preferred portable unit bracelet 10', FIG. 3 is ergonomic, waterproof, and robust. The electronics housed therein preferably meet FCC regulations and can operate for many (e.g., 45) days on a single battery when not in the search mode and for up to 72 hours when in the search mode. Transmitter 22, FIG. 2 typically provides a signal that can be detected from up to a mile away. Transponder 20 emits a signal which can be tracked from at least five miles away. Both the transmitter and the transponder emit signals which include some type of an identifier or code. The preferred bracelet fits wrists from 4 inches to 14 inches in diameter and may include a special tool to attach and remove the bracelet from a person's wrist.

Thus although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. For example, the transmitters, transponders, and receivers disclosed could be the relevant circuitry of a transceiver or other equivalent device.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant cannot be expected to describe certain insubstantial substitutes for any claim element amended.

Other embodiments will occur to those skilled in the art and are within the following claims.

What is claimed is:

1. A proximity monitoring and locating system comprising:

a wearable unit including:

a transmitter configured to send a signal, a receiver, and a transponder outputting a transponder signal when activated;

a proximity detector including:

a receiver for receiving the wearable unit transmitter signal, a processing subsystem configured to signal an alert if the wearable unit transmitter signal strength is below a pre-established minimum, and a tracking subsystem configured to assist in locating the wearable unit based on the signal strength of the wearable unit transmitter signal;

a control subsystem responsive to an indication that the alert has been signaled, the control subsystem including:

an RF transmitter configured to transmit a transponder activation signal, an RF antenna network for relaying the transponder activation signal to the receiver of the wearable unit to activate the transponder thereof; and a tracking unit including a receiver configured to receive the transponder signal of the wearable unit to locate the wearable unit.

2. The system of claim 1 in which the wearable unit includes a bracelet.

3. The system of claim 1 in which the wearable unit transmitter and the proximity detector receiver operate in an unlicensed frequency.

4. The system of claim 3 in which said unlicensed frequency is 902 MHz.

5. The system of claim 1 in which the transponder emits a signal at 173, 0.075 MHz.

6. The system of claim 1 in which the proximity detector includes a communication link with a control subsystem for transmitting the alert to the control subsystem.

7. The system of claim 6 in which the proximity detector includes a modem and the processing subsystem is configured to automatically notify the control subsystem via the modem when the wearable unit transmitter signal strength is below the pre-established minimum to alert the control subsystem.

8. The system of claim 6 in which the communication link includes an internet connection between the proximity detector and the control subsystem.

9. The system of claim 6 in which the communication link includes a wireless communication link between the proximity detector and the control subsystem.

10. The system of claim 6 in which the control subsystem includes a database of proximity detectors and wearable units and corresponding message recipients and is configured to send a message to a message recipient when an alert is signaled by a given proximity detector.

11. The system of claim 1 in which the proximity detector includes a base unit and the tracking subsystem is removable from the base unit in order to assist in an initial locating effort.

12. The system of claim 1 in which the wearable unit further includes a GPS subsystem for tracking the wearable unit.

13. The system of claim 1 in which the wearable unit further includes a cell phone modem for tracking the wearable unit.

14. The system of claim 1 in which the wearable unit further includes a cell phone modem for communicating with the wearable unit.

15. The system of claim 1 further including a separate activation unit configured to activate the transponder of the wearable unit.

16. A proximity monitoring and locating system comprising:

a wearable unit including:

a transmitter configured to send a signal, a receiver, and a transponder outputting a transponder signal when activated;

a proximity monitor including:

a handheld tracking receiver for receiving the wearable unit transmitter signal, a base unit configured to cradle the handheld tracking receiver, and a processing subsystem configured to monitor the wearable unit transmitter signal strength;

a control subsystem including:

an RF transmitter configured to transmit a transponder activation signal, an RF antenna network for relaying the transponder activation signal to the receiver of the wearable unit to activate the transponder thereof;

a tracking unit including a receiver configured to receive the transponder signal of the wearable unit to locate the wearable unit; and a communication link between the proximity monitor and the control subsystem for issuing an alert if the signal strength of the wearable unit transmitter is below a pre-established minimum so that the handheld tracking receiver can be used in an attempt to locate the wearable unit before the transponder thereof is activated and the tracking unit is used to locate the wearable unit.

17. A proximity monitoring and locating system comprising:

a wearable unit including:

a transmitter configured to send a signal, a receiver, and a transponder outputting a transponder signal when activated;

a proximity detection subsystem configured to determine if the wearable unit is present in a predetermined area;

a control subsystem responsive to an indication that the proximity detection subsystem had determined that the wearable unit is not within the predefined area, the control subsystem including:

an RF transmitter configured to transmit a transponder activation signal, and an RF antenna network for relaying the transponder activation signal to the receiver of the wearable unit to activate the transponder thereof.

18. The system of claim 17 further including a tracking unit with a receiver configured to receive the transponder signal of the wearable unit to locate the wearable unit.

19. The system of claim 17 in which the proximity detection subsystem includes a handheld tracking receiver for receiving the wearable unit transmitter signal, a base unit configured to cradle the handheld tracking receiver, and a processing subsystem configured to monitor the wearable unit transmitter signal strength.

20. The system of claim 17 further including a communication link between the proximity detection subsystem and the control subsystem for issuing an alert if the signal strength of the wearable unit transmitter is below a pre-established minimum so the proximity detection subsystem can be used in an attempt to locate the wearable unit before the transponder thereof is activated.

21. The system of claim 17 in which the wearable unit includes a bracelet.

22. The system of claim 17 in which the wearable unit transmitter and the proximity detector receiver operate in an unlicensed frequency.

23. The system of claim 22 in which said unlicensed frequency is 902 MHz.

24. The system of claim 17 in which the transponder emits a signal at 173 MHz.

25. The system of claim 17 in which the proximity detection subsystem includes a modem and a processing subsystem configured to automatically notify the control subsystem via the modem when the wearable unit transmitter signal strength is below pre-established minimum to alert the control subsystem.

26. The system of claim 17 further including an internet connection between the proximity detection subsystem and the control subsystem.

27. The system of claim 17 further including a wireless communication link between the proximity detection subsystem and the control subsystem.

28. The system of claim 17 in which the control subsystem includes a database of wearable units and corresponding message recipients and is configured to send a message to a message recipient when an alert is issued from a proximity detection subsystem.

29. The system of claim 17 in which the proximity detection subsystem includes a base unit and a tracking subsystem is removable from the base unit in order to assist in a locating effort.

30. The system of claim 17 in which the wearable unit further includes a GPS subsystem for tracking the wearable unit.

31. The system of claim 17 in which the wearable unit further includes a cell phone modem for tracking the wearable unit.

32. The system of claim 17 in which the wearable unit further includes a cell phone modem for communicating with the wearable unit.

33. The system of claim 17 further including a separate activation unit configured to activate the transponder of the wearable unit.

* * * * *